US006933906B2

(12) United States Patent
Stolle et al.

(10) Patent No.: US 6,933,906 B2
(45) Date of Patent: Aug. 23, 2005

(54) ANTENNA HAVING AT LEAST ONE DIPOLE OR AN ANTENNA ELEMENT ARRANGEMENT WHICH IS SIMILAR TO A DIPOLE

(75) Inventors: Manfred Stolle, Bad Aibling (DE); Andreas Scheyer, Tuntenhausen (DE)

(73) Assignee: Kathrein-Werke KG, Rosenheim (DE)

( * ) Notice: Subject to any disclaimer, the term of this patent is extended or adjusted under 35 U.S.C. 154(b) by 56 days.

(21) Appl. No.: 10/441,265

(22) Filed: May 20, 2003

(65) Prior Publication Data

US 2004/0201537 A1 Oct. 14, 2004

(30) Foreign Application Priority Data

Apr. 10, 2003 (DE) ..... 103 16 564

(51) Int. Cl.[7] ..... H01Q 21/26
(52) U.S. Cl. ..... 343/797
(58) Field of Search ..... 343/700 MS, 846, 343/850, 770, 808, 813, 872, 893, 911 R, 797

(56) References Cited

U.S. PATENT DOCUMENTS 5,708,446 A 1/1998 Laramie
5,821,902 A 10/1998 Keen
5,835,062 A * 11/1998 Heckaman et al. .. 343/700 MS
5,952,983 A 9/1999 Dearnley et al.
6,037,911 A 3/2000 Brankovic et al.
6,067,053 A * 5/2000 Runyon et al. ..... 343/797
6,492,949 B1 * 12/2002 Breglia et al. ..... 343/700 MS
6,642,908 B2 * 11/2003 Pleva et al. ..... 343/876

FOREIGN PATENT DOCUMENTS

| | | |
|---|---|---|
| DE | 43 27 277 C2 * | 2/1995 |
| DE | 196 27 015 A1 | 1/1998 |
| DE | 197 22 742 A1 | 12/1998 |
| DE | 198 60 121 A1 | 7/2000 |
| EP | 0 709 913 A2 | 5/1996 |
| WO | WO 97/22159 | 6/1997 |
| WO | WO 00/39894 | 7/2000 |

* cited by examiner

*Primary Examiner*—Wilson Lee
*Assistant Examiner*—Minh Dieu A
(74) *Attorney, Agent, or Firm*—Nixon & Vanderhye P.C.

(57) ABSTRACT

An improved antenna having at least one dipole or an antenna element arrangement which is similar to a dipole is distinguished in that the antenna element arrangement is connected capacitively and/or electrically conductively without touching to the reflector or to a reflector or a substrate which is non-conductive at least in the area in which the antenna element arrangement is attached or mounted.

13 Claims, 4 Drawing Sheets

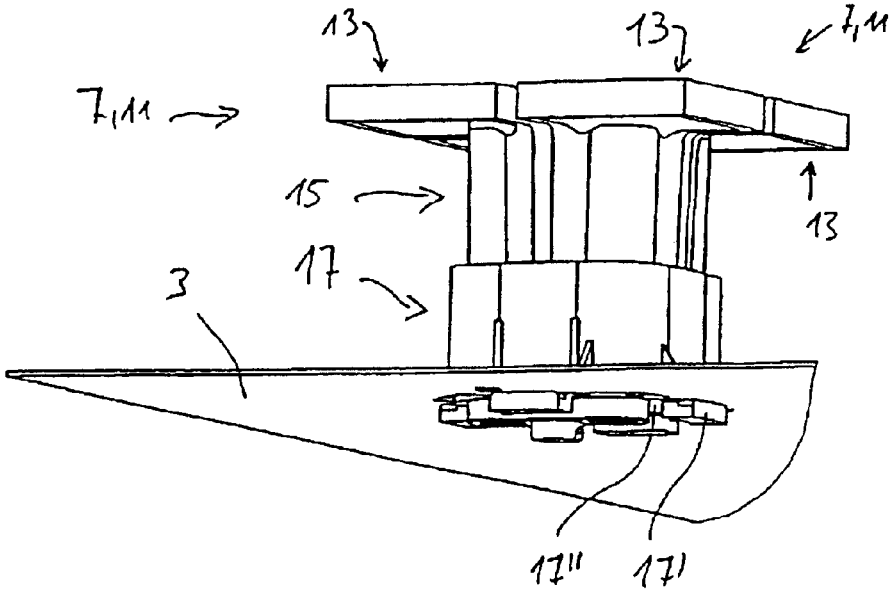
Fig. 2
Fig. 3
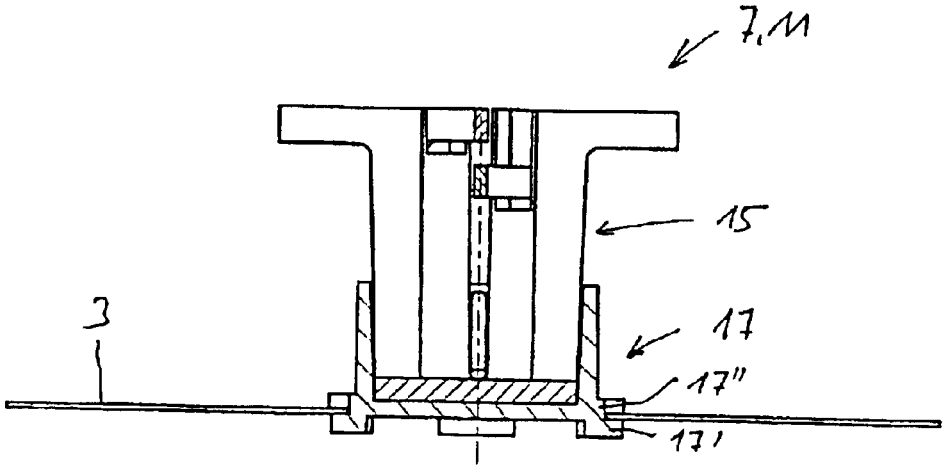

ANTENNA HAVING AT LEAST ONE DIPOLE OR AN ANTENNA ELEMENT ARRANGEMENT WHICH IS SIMILAR TO A DIPOLE

FIELD

The technology herein relates to an antenna having at least one dipole or an antenna element arrangement which is similar to a dipole.

BACKGROUND AND SUMMARY

Dipole antenna elements have been disclosed, for example, in the prior publications DE 197 22 742 A and DE 196 27 015 A. The dipole antenna elements may in this case comprise a normal dipole structure or, for example, may comprise a cruciform dipole arrangement or a dipole square, etc. A so-called reflector cruciform dipole is disclosed in the prior publication WO 00/39894. The structure appears to be comparable with a dipole square. Owing to the specific configuration of the dipole antenna element according to this prior publication, however, this results in the end in a cruciform dipole structure such that the antenna element formed in this way can transmit and receive in two mutually perpendicular polarizations. All of these prior publications, as well as the other dipole structures which have been known to an average person skilled in the art for a long time, are to this extent also included in the content of the present application.

The object of the exemplary illustrative non-limiting technology herein is to provide an improved antenna having at least one dipole or an antenna element which is similar to a dipole, which has characteristic electrical characteristic values which are clearly reproducible in comparison to conventional antennas and which, if required, may in this case even be assembled more easily.

While, until now, all generations of dipole antenna elements or of antenna elements which are similar to dipoles have been based on the idea of them being mounted on a reflector plate such that they are electrically conductively connected to it, the exemplary illustrative non-limiting implementation is in contrast based on the idea of an antenna element such as this being capacitively coupled to the reflector plate. With the interposition of a non-conductive element, in particular a dielectric, this means that the antenna element can be positioned in a clearly reproducible manner from the electrical point of view, on the reflector plate, since the intermodulation problems which occur in some circumstances according to the prior art are avoided. This is because, when a dipole or antenna elements which are similar to dipoles is or are mechanically mounted on the reflector plate according to the prior art, it or they have until now normally been fitted on the reflector plate by means of screws or other connecting mechanisms, thus resulting in different contact relationships depending on the assembly accuracy, with the consequence that intermodulation problems could occur, and express themselves in different ways.

In this case, it is also necessary to remember that, in the majority of all situations, the dipoles or antenna elements which are similar to dipoles are fitted on the reflector plate and are attached from the rear face of the reflector by screwing in one or more screws. However, if the contact pressure also decreases, for example as a result of thermal influences, then the contact relationships change, thus significantly detracting from the performance of an antenna element such as this.

A dipole or an antenna element which is similar to a dipole is thus preferably mounted, together with the dipole halves which actually transmit and receive and with its or their balancing device which is preferably integrally connected to it, on an electrically non-conductive cap, which is in turn fixed on the reflector plate.

However, a modified form is also possible, in which a dipole or antenna element which is similar to a dipole and which in either case is electrically conductive overall is used, including an electrically conductive attachment cap, but in which case, in order to avoid any conductive contact with the reflector, no insulating intermediate cap or non-conductive intermediate layer is used and, instead of this, the dipole or the antenna element which is similar to a dipole is, for example, coated or provided, at least in the area of its attachment section located at the bottom, with a plastic layer, that is to say in general an electrically non-conductive surface.

It is thus evident from the above statements that there is no conductive contact between the dipole or the dipole arrangement and the reflector, but that a capacitive coupling is produced by the preferably insulated mounting process. This also results in the advantage that no potential difference can occur between the dipole and the reflector. This is because the differently chosen materials for a dipole antenna element or the balancing device for a dipole antenna element and the material of the reflector mean that an electrochemical voltage is otherwise normally formed, which can lead to contact corrosion. Since the exemplary illustrative non-limiting implementations avoid this, this also results in a greater possible range of choice for the materials to be used for the dipole and/or for the reflector.

Furthermore, according to exemplary illustrative non-limiting implementations, it is also possible to use plastic dipoles which have only partial metallization, that is to say in particular with these plastic dipoles not being metallized in the area in which they make contact with and are connected to the reflector. The balancing device is in this case preferably regarded as being electrically conductive, as part of the dipole arrangement.

Finally, the principle according to exemplary illustrative non-limiting implementations also results in the mechanical and electrical functions being separated. There is now no need for any high contact or surface pressures, since there is no longer any need for a permanent electrical contact connection all the time between the dipole and its balancing device on the reflector.

Finally, an exemplary illustrative non-limiting dipole arrangement may also be plugged directly onto a board mount so that no additional plastic part is required in situations such as these. The feed could in this case be provided directly via the rear face of the board structure, on which the matching structure is provided.

The explained principle in this case applies to all types of dipoles, vertical dipoles, dipoles polarized in an X-shape (that is to say at angles of ±45° to the horizontal) for single-band antennas, dual-band antennas or for dipole structures, in particular square dipole structures, in which two or more antenna elements are arranged within one another and are intended for different frequency bands.

In one preferred exemplary illustrative non-limiting implementation, a suitable stamped-out area is provided in the reflector plate, into which the attachment cap of the antenna element can, for example, be clipped or inserted, and can be rotated etc. to the final fixing position. In this case, locking and attachment elements can be used, for example those known in the form of so-called bayonet fittings, including all the modified forms associated with them.

BRIEF DESCRIPTION OF THE DRAWINGS

These and other features and advantages will be better and more completely understood by referring to the following detailed description of exemplary non-limiting illustrative implementations in conjunction with the drawings of which:

FIG. 2: shows a further perspective illustration of the exemplary illustrative non-limiting antenna element arrangement shown in FIG. 1 on a reflector, but viewed slightly from the rear;

FIG. 3: shows a vertical cross-sectional illustration through the exemplary illustrative non-limiting arrangement shown in FIGS. 1 and 2;

DETAILED DESCRIPTION

Figure 4:
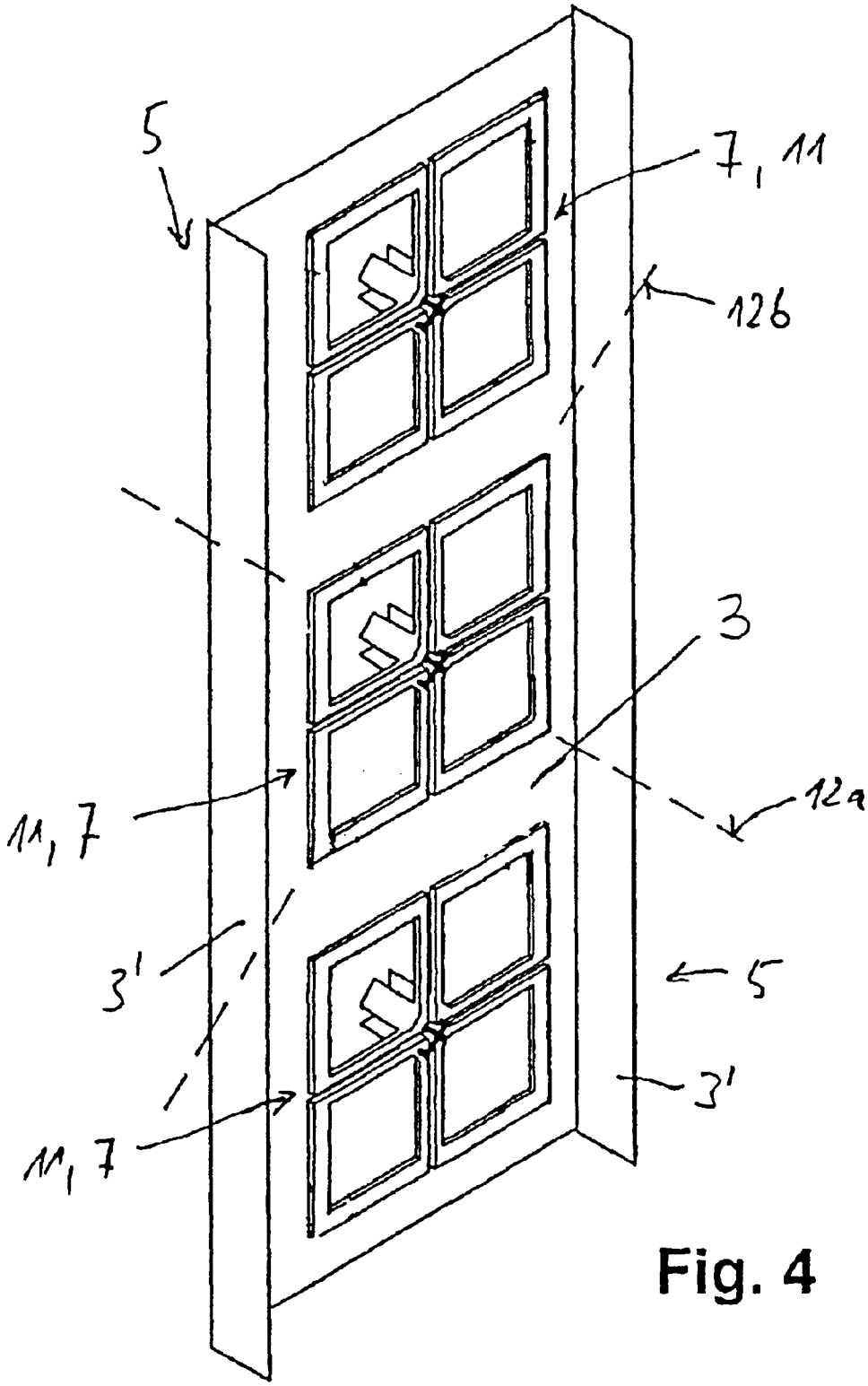
FIG. 4: shows a schematic perspective illustration of an exemplary illustrative non-limiting antenna arrangement with three antenna elements arranged vertically one above the other.

FIG. 4 shows a schematic illustration of an antenna arrangement 1 with a reflector or reflector plate 3. The reflector 3 can be provided with a reflector boundary 3', preferably on its two opposite longitudinal sides 5, which reflector boundary 3' may, for example, be aligned at right angles to the plane of the reflector plate 3 or else at an obliquely running angle, which is not a right angle.

Two or more dipoles or antenna elements which are similar to dipoles are normally arranged offset in the vertical direction on one such reflector plate 3. The antenna element or the antenna element arrangements 7 may comprise single-band antenna elements, dual-band antenna elements, triple-band antenna elements or the like. With the modern generation of antennas, dual-band antenna elements or even triple-band antenna elements are preferably used, which can also transmit and/or receive in two mutually orthogonal polarizations and which in this case are preferably aligned at angles of ±45° to the horizontal or vertical. In this case, reference is made in particular to the prior publications DE 197 22 742 A and DE 196 27 015 A, which illustrate and describe different antenna with widely differing antenna element arrangements. All of these antenna elements as well as further modified forms may be used for the purposes of exemplary illustrative non-limiting implementations. It is thus also possible to use antenna elements with a real dipole structure, in the form of a cruciform dipole, a dipole square or in the form of a so-called vector dipole, as is known by way of example from WO 00/39894. All of these antenna element types and modified forms are included in the content of this application by reference to the prior publications cited above.

Figure 1:
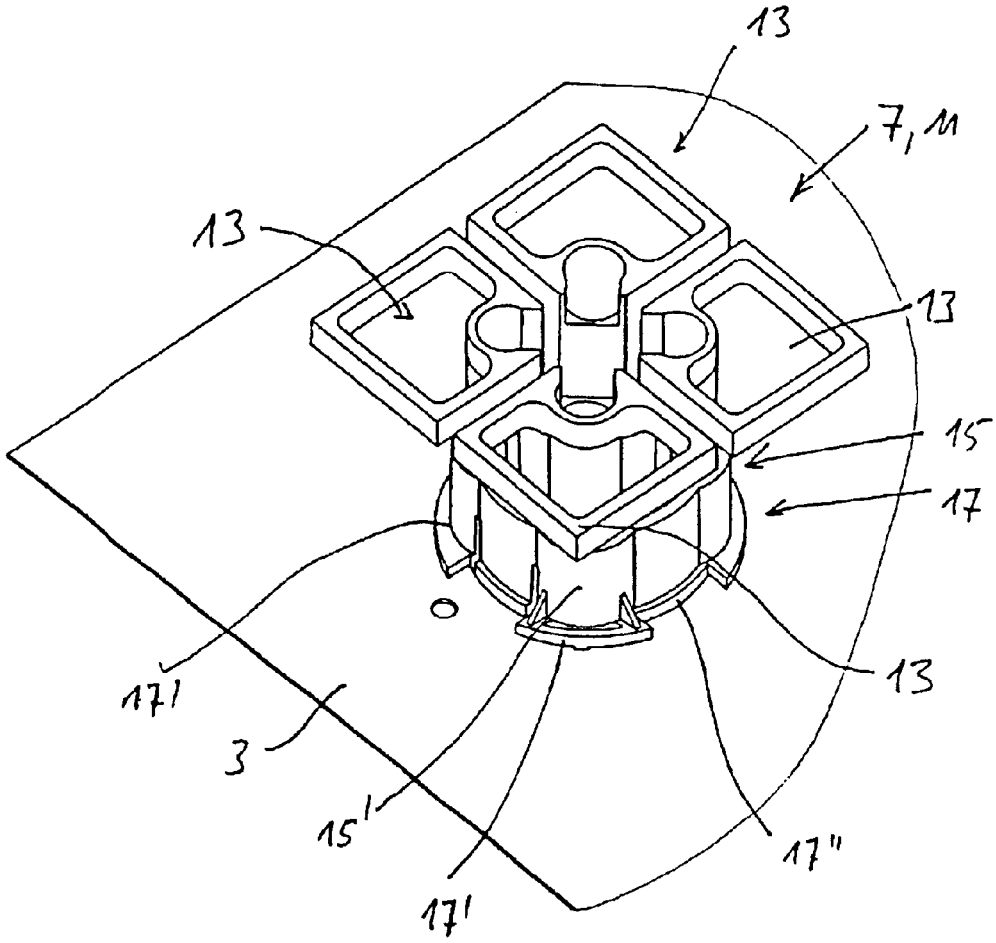
FIG. 1: shows a schematic perspective illustration of one exemplary illustrative non-limiting implementation.

FIGS. 1 to 3 show a first exemplary illustrative non-limiting antenna element arrangement 11, on a reflector 3 illustrated in different forms in relatively great detail. In this case, fundamentally, the antenna element arrangement 11 is of the same configuration as that which is known from WO 00/39894, and which is described in detail in this prior publication. Reference is therefore made to the full scope of the disclosure content of said publication, which is included in the content of this application. From this, it is known for the antenna element arrangement 11 as illustrated schematically in the form of a plan view in the exemplary illustrative non-limiting arrangements in FIGS. 1 to 4 to be in the form of a dipole square, but to transmit and receive in the same way as a cruciform dipole, from the electrical point of view, by virtue of the specific configuration. FIG. 4 in this case shows the two polarization directions 12*a* and 12*b* for an antenna element arrangement 11, with these two polarization directions being at right angles to one another and being formed by the diagonal, by means of the antenna element arrangement 11 which effectively is in the form of a square when seen in a plan view.

The structures which are, in each case, inverted through 180° with respect to one another in the antenna element arrangement 11 to this extent act as dipole arms of two dipoles arranged in a cruciform shape.

An antenna element 11 in the form of a dipole formed in this way is held and mounted on the reflector 3 via the associated balancing device 15. The dipole halves 13 and the balancing device 15 are in this case composed of an electrically conductive material, generally metal or a metal alloy.

Figure 5:
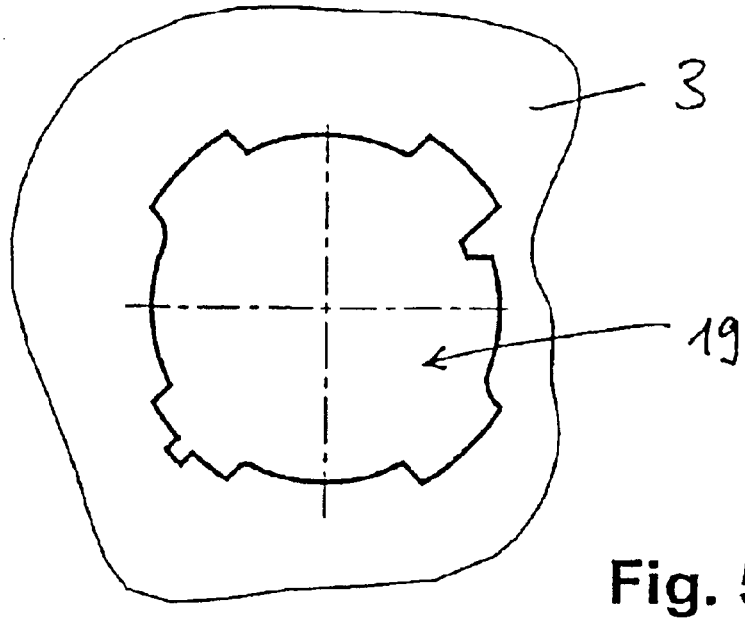
FIG. 5 shows an exemplary schematic plan view of a reflector with an opening incorporated there for fixing a cap of an antenna element arrangement as shown in FIGS. 1 to 4.

In order now to ensure capacitive coupling on the reflector plate 3, that is to say to provide an electrical connection without any physical contact, a cap 17 is provided which is composed of non-conductive material, for example a plastic, a dielectric, etc. The associated cap section 15' of the balancing device 15 is fixed and held via this cap 17. The cap 17 is now in turn anchored in a recess 19 (FIG. 5) in the reflector plate 3. This may, for example, be done in such a way that the cap 17 has, in particular, radially protruding projections 17', that is to say projections 17' which protrude at the sides, as well as set-back sections 17" so that this shape allows the cap to be inserted into a correspondingly shaped recess 19 in the reflector plate. After being inserted, the entire arrangement may, for example, be rotated through an angle of about 30° or 45°, until the final adjustment position is reached, which ensures that the cap 17 is held securely, preferably by means of a force fit, with respect to the recess 19, with the projections which protrude radially on the rear face or lower face of the reflector 3 engaging under the corresponding material sections of the reflector while, in contrast, other projections 17' which are located at the top engage over parts of the reflector plate from above, that is to say in this way securely fixing the antenna element arrangement 11. If necessary, additional fixing means may be used, including interlocking fixing means, in order to ensure that the antenna element arrangement is held securely. Finally, screws can even additionally be screwed in through the plastic cap, for example also passing through the reflector plate in a further separate hole, but these are not electrically conductively connected to the antenna element arrangement of the balancing device.

Since the cap is composed of plastic the balancing device and the antenna element arrangement 11 overall are separated and isolated from the electrically conductive reflector or reflector plate 3 by means of the cap, this results in capacitive coupling.

Figure 6:
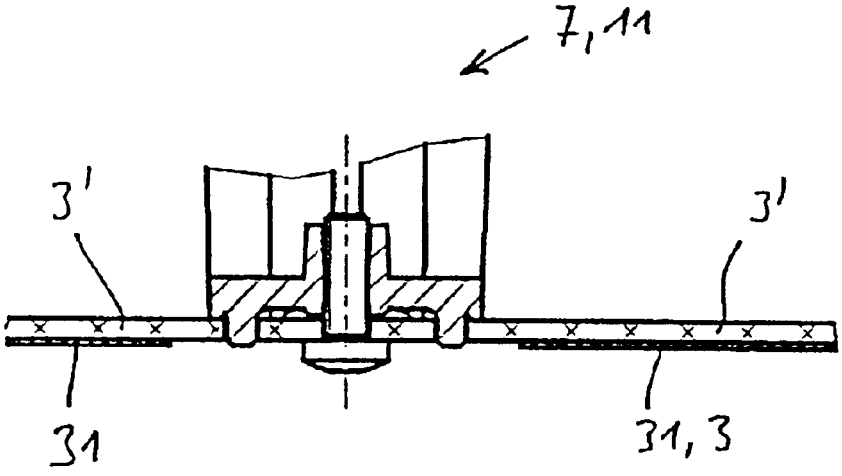
FIG. 6 shows an exemplary illustrative non-limiting arrangement, modified from that shown in FIGS. 1 and 3.

As an alternative to the explained exemplary arrangement, a board structure 3' or some other substrate 3' can also be provided instead of the reflector plate 3, provided that it is nonconductive or is non-conductive at least in the anchoring area of the cap or of the antenna element. This is shown in a schematic cross-sectional illustration, in the form of an extract, in FIG. 6. Conductive structures on the lower face of the board, particularly large-area conductive structures 31 on the board in order to produce a reflector or metallization similar to a reflector, can be provided on the upper face or on the lower face of the substrate or of the board 3', but in this case should not extend as far as the attachment area of the balancing device of an antenna element 7 or of an antenna element arrangement 11. There is therefore no need for any electrically non-conductive cap in this situation. The antenna element with its antenna element structure can be fitted and anchored directly on the non-conductive substrate or on the non-conductive board structure. The substrate can, in this case, preferably be formed from a board on whose rear face the electrically conductive matching structures are formed, without this resulting in any conductive coupling to the balancing device.

A modified form is likewise possible in which the entire antenna element including the balancing device is likewise once again composed of an electrically conductive material, with the cap section 15' of the antenna element arrangement in this exemplary illustrative non-limiting implementation being coated with an electrically non-conductive material, plastic or a dielectric, and being fixed to the reflector plate via this coating. This also ensures a capacitive link to the reflector plate, that is to say an electrically non-conductive link with no physical contact.

Conversely, however, the antenna element arrangement or at least the balancing device overall, or essential parts of it, may be formed from non-conductive material which is then coated with a conductive structure, in particular a metallizing layer. Only those anchoring sections by means of which the antenna element 11 which is formed in this way is, for example, mounted on a conductive reflector 3 are excluded from this metallically conductive surface structure, in order to avoid an electrically conductive connection.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

What is claimed is:

1. An antenna comprising:

a reflector that is at least partially conductive, an electrically conductive balancing device including a base section, at least one dipole mounted on said conductive balancing device, and a non-electrically-conductive coupling structure that fastens and couples said conductive balancing device base section to said reflector without establishing an electrical connection therebetween.

2. The antenna of claim 1, wherein the coupling structure capacitively couples said balancing device base section to said reflector.

3. The antenna of claim 1 wherein the structure comprises a non-conductive socket fixed to the reflector.

4. The antenna of claim 1 if wherein the structure includes a recess defined within the reflector, said base section engaging and passing at least partially through the recess.

5. The antenna of claim 1 wherein said structure comprises an electrically non-conductive intermediate layer that electrically isolates the reflector from the balancing device, the dipole and the coupling structure.

6. The antenna of claim 1 wherein the coupling structure comprises a non-conductive coating disposed on said base section.

7. The antenna of claim 6 wherein the coating comprises a dielectric.

8. The antenna of claim 1 wherein the reflector provides a surface to which said base section is attached, and the structure comprises an electrically non-conductive surface layer disposed on at least the portion of said reflector surface to which said base section is attached.

9. The antenna of claim 1 wherein the balancing device comprises a non-conductive material coated with an electrically conductive layer, said electrically conductive layer being absent within an area used to attach said balancing device to said reflector, said reflector being electrically conductive.

10. The antenna of claim 1 wherein the reflector defines a mounting and support area for mounting and supporting said balancing device base section, said reflector mounting and support area being non-conductive.

11. The antenna of claim 1 wherein the reflector comprises a board structure having a rearward face facing away from said dipole, and said antenna further includes a matching structure disposed at least in part on said rearward face.

12. The antenna of claim 1 wherein said base section is rotatably insertable into said reflector so as to mechanically fix said base section to said reflector.

13. An antenna comprising:

a reflector, an electrically conductive balancing device including a base section, at least one dipole mounted on said conductive balancing device, and a non-electrically-conductive coupling structure that couples said conductive balancing device base section to said reflector without establishing an electrical connection therebetween, said coupling structure at least in part comprising a recess defined within said reflector, said base section engaging and anchoring within said recess.

* * * * *